United States Patent [19]

Nigrelli et al.

[11] 4,227,388

[45] Oct. 14, 1980

[54] SECURITY COVERING BOX

[76] Inventors: Gus Nigrelli; Bruce Baron, both of 1036 E. 99 St., Brooklyn, N.Y. 11236

[21] Appl. No.: 11,180

[22] Filed: Feb. 12, 1979

[51] Int. Cl.[2] ..... E05B 17/18

[52] U.S. Cl. ..... 70/427; 220/210; 70/77

[58] Field of Search ..... 220/210, 85 P, 345, 220/346; 70/77, 78, 423, 427

[56] References Cited

U.S. PATENT DOCUMENTS

| | | | |
|---|---|---|---|
| 2,883,849 | 4/1959 | Lorenzo | 70/427 |
| 4,135,375 | 1/1979 | Voegeli | 220/210 X |

*Primary Examiner*—George T. Hall

*Attorney, Agent, or Firm*—Friedman, Goodman & Teitelbaum

[57] ABSTRACT

A protective box for providing a secure covering for a closure device, such as a lock, bolt, or the like. The protective box includes a housing having a rear wall which has an opening therein for access to the closure device to be protected. The rear wall is securely fastened onto the support surface containing the closure device, such as onto a door or wall supporting a lock. A cover member closes the front of the housing and is slidable between a closed position providing an enclosed area within the housing into which the closure device can face, and an open position whereby access can be had to the closure device. A lock mounted on the cover member engages with a roller assembly provided in the housing to securely retain the cover member in its closed position. In a modified form, two locks can be mounted on the cover member for engagement with associated latching elements disposed on the housing.

11 Claims, 15 Drawing Figures

SECURITY COVERING BOX

BACKGROUND OF THE INVENTION

This invention relates to security devices, and more particularly to a protective box which provides an additional level of security to a closure device, such as a lock, bolt, or the like.

Closure devices, such as locks, bolts, and the like, are generally utilized to protect an apparatus or a premises. For example, a door lock is generally used as part of the front door of a house, store, or other areas to be protected. Other locks, such as cylinder locks, pad locks, combination locks, etc., are also utilized to protect doors, trunks, drawers, and many other parts. In addition to locks, bolts are often used to securely retain interconnected assemblies. For example, an outboard motor can be securely bolted onto the hull of a boat for permanent retention.

In each of these situations, it has been found that despite the presence of the particular closure device, such as the lock or bolt, the articles or premises are still not completely protected and are still vulnerable to burglaries and unauthorized entry. Accordingly, in addition to the normal closure device, an additional level of security is often desired to provide additional protection as well as to provide increased avoidance to penetration. The increased level of protection that is available is to utilize an apparatus which serves to protect the existing closure device. For example, by placing an enclosure around an existing door lock, with the enclosure itself suitably locked, there can be added the additional level of security as desired.

With this type of arrangement, a burglar must first penetrate the enclosure box prior to gaining access to the normal door lock. The existence of this additional enclosure often provides sufficient deterrent to prevent an unauthorized individual from attempting to gain access to the premises.

Where the closure device is only a bolt, the presence of the enclosure surrounding and protecting the bolt provides security to prevent individuals from removing the bolt. For example, where an outboard motor is connected to the hull of the boat by means of a bolt, the use of the protective enclosure over the bolt will prevent an unauthorized individual from removing the bolt and hence taking the motor.

One of the basic problems, however, with such enclosures around locks, bolts or the like, is the awkwardness and difficulty which it presents to the authorized individual who has permission to use the premises. For example, the owner of a house, who has a protective enclosure around his door lock, must continuously open the enclosure before he can open the door lock. This presents an inconvenience, and frequently, the owner foregoes the safety benefits of such an enclosure because of its inconvenient manipulation and thereby does not gain the benefit of the enclosure.

Additionally, many of the presently available security boxes provide doors which fall off, parts which can be lost, locks which must be continuously manipulated and opened, and awkward construction so that it presents more problems then solutions.

SUMMARY OF THE INVENTION

It is accordingly an object of the present invention to provide a protective box for securely covering a closure device, which avoids the aforementioned problems of prior art devices.

A further object of the present invention is to provide a protective box which can be used for securely covering a lock, bolt, or the like, and which is easy to manipulate and provides an additional level of security.

Still another object of the present invention is to provide a protective box which forms an enclosure over a lock, bolt, or the like, and which includes a slidable cover member which can be securely locked onto the enclosure housing.

A further object of the present invention is to provide a protective box for securely covering a closure device which includes a housing, and a slidable cover member on the housing, and wherein the slidable cover member is restrained from removal from the housing thereby avoiding the problem of losing the cover member.

Another object of the present invention is to provide a protective box for providing a secure covering for a closure device and having a cover member which can be locked onto a housing, and wherein the device can be in a potentially locked position whereby sliding the cover member in its closed position automatically locks the cover member in place.

Another object of the present invention is to provide a protective box for securely covering a closure device and which provides easy use by an authorized individual and a high level of security against an unauthorized individual.

Briefly, the present invention provides a protective box for securely covering a closure device disposed on a support surface, such as a lock, bolt, or the like. The protective box includes a housing having a rear wall and perimetric walls forwardly extending from the rear wall. An opening is formed in the rear wall for providing access to the closure device to be protected. Fasteners securely hold the housing onto the support surface around the closure device. A cover member closes the front of the housing and is slidable between a closed position providing an enclosed area within the housing into which the closure device can face, and an open position permitting access to the closure device. A lock is coupled between the cover member and the housing for securely retaining the cover member in its closed position.

A feature of the present invention is that the lock is so arranged between the cover member and the housing whereby sliding the cover member from its open position to its closed position automatically locks it in place without the need of a key for locking the cover member closed. In a modified form, two locks having the above mentioned feature can be mounted on the cover member for automatic locking engagement with associated latching elements disposed on the housing.

Another feature of the present invention is that a spring loaded pin is mounted on the housing and is available for engaging against a detent formed in the cover member to hold the cover member in its open position to avoid complete removal from the housing, thereby avoiding the problem of losing the cover member and yet permitting it to retain its sliding ability with respect to the housing.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
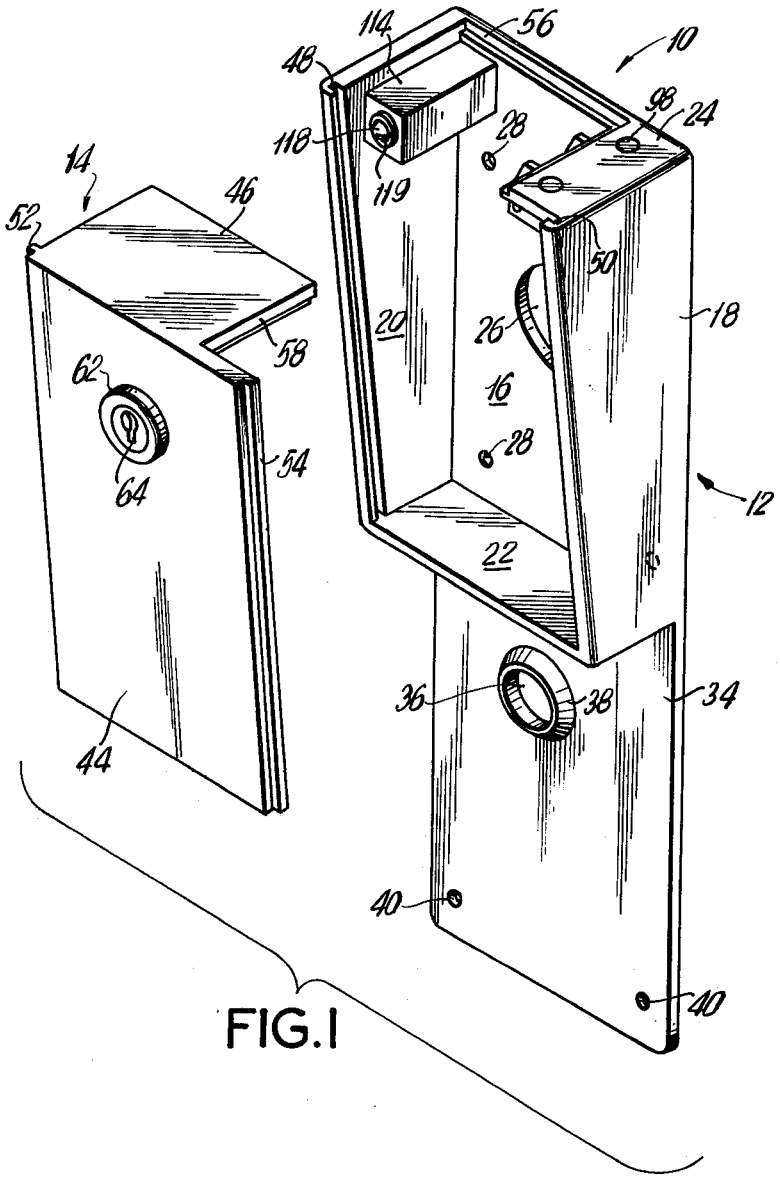
FIG. 1 is an exploded isometric view of an embodiment of the protective covering box of the present invention.
Figure 3:
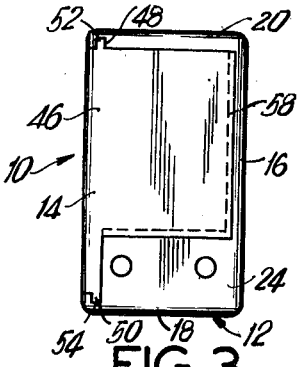
FIG. 3 is a top plan view of the protective box shown in FIG. 2.
Figure 2:
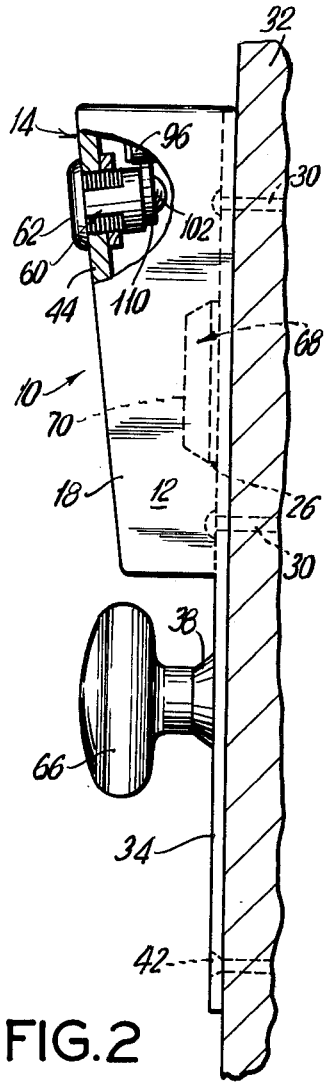
FIG. 2 is a partially broken away side elevational view of the protective box mounted in position on a door.

Referring now to FIGS. 1–3, there is shown an embodiment of the protective box of the present invention, shown generally at 10, and including a housing 12 in conjunction with a cover member 14. The housing 12 includes a rear wall 16 with forwardly extending sidewalls 18 and 20, a bottom wall 22 interconnecting the sidewalls, and a portion of a top wall 24 partially extending across the top of the housing.

An opening 26 is formed in the rear wall 16 for providing access to or receiving a particular closure device to be protected. Clearance holes 28 are provided in the rear wall 16 for receiving fastening members 30, as shown in FIG. 2, for securely fastening the housing onto a support surface 32, such as a door.

A downwardly depending plate 34 extends from the housing and includes an additional opening 36 with a boss 38 thereabout. The opening 36 is available for receiving a corresponding part of the closure device, as will hereinafter be described. Additional clearance holes 40 are also provided in the depending plate 34 for also receiving fastening means, shown as the screws 42, to retain it onto the support surface 32.

The cover member 14 includes a front panel portion 44 which can slide downwardly and close the housing. An inwardly directed top plate portion 46 is connected to the front panel portion 44 and is formed of a size to complement the top wall portion 24 provided on the housing 12. As shown in FIG. 3, when the cover member 14 is in place, the top plate portion 46 complements the top wall portion 24 to form an integral and complete top wall for the protective box to thereby enclose the internal area within the housing.

To facilitate the sliding movement of the cover member 14 with respect to the housing 12, tongue and groove joints are formed which includes the laterally directed, longitudinally extending grooves or channels 48, 50, formed respectively in the walls 20, 18 and the lateral edges of the panel portion 44 including the laterally directed, longitudinally extending tongues 52, 54, which respectively slide in the grooves 48, 50.

In order to provide for a complete enclosure and avoid the possibility of penetrating the enclosed area by means of a tool, an overlap joint is provided between the mating top portions of the housing and the cover member. Specifically, a seat 56 is formed about the top edge of the rear wall 16 and the side of top wall portion 24 of the housing. An overhanging lip 58 is formed on the mating edges of the top plate portion 46 of the cover member. When the cover member is moved into its closed position covering the face of the housing, the lip 58 and seat 56 mate to form the overlap joint. As a result, it is not possible to wedge a tool in between the mating edge portions to break open the housing.

The cover member 14 can be inserted with its laterally extending tongues 52, 54 in the receiving grooves 48, 50 of the housing, and can thereby be slid upward and downward. In its downward position, it completely closes the housing to protect anything positioned within or behind the housing. A conventional lock, shown generally at 60, is attached to the panel portion 44 of the cover member 14 and is externally available, through its face plate 62, for insertion of a key into the keyway 64 to open and close the lock 60 in a conventional manner.

In its locked position, the lock 60 can securely retain the cover member onto the housing and prevent its opening. In its unlocked position, the cover member can be upwardly slid to thereby gain access to the inside of the housing.

With reference to FIG. 2, there is shown one possible use of the protective box. The support surface 32 is shown as a conventional door and includes a conventional doorknob 66 extending from the door, and also includes the conventional door lock 68, shown in phantom lines as a cylinder type lock with a conventional face plate 70 readily available for insertion therein of a key to open the door. The housing 12 is securely fastened to the door 32 by means of the screws 30 inserted through the openings 28 of the rear wall 16 of the housing 12. The face plate 70 of the door lock 68 is placed through the opening 26 formed in the rear wall 16. The doorknob 66 is first removed and then replaced through the opening 36 in the depending plate 34, which is secured by the screws 42 mentioned above. The boss 38 provides a finished surface beneath the doorknob 66. The cover member 14 is then slid in place and the lock 60 is then locked to keep the cover member securely covering the housing.

When the cover member 14 is locked onto the housing 12, the door lock 68 is protected and manipulation of the door lock is prevented by any unauthorized user. When access to the door lock is desired, the lock 60 is opened to permit sliding of the cover member upward thereby gaining access to the inside of the housing and permitting insertion of a key into the keyway of the face plate 70 of the door lock 68.

Figure 4:
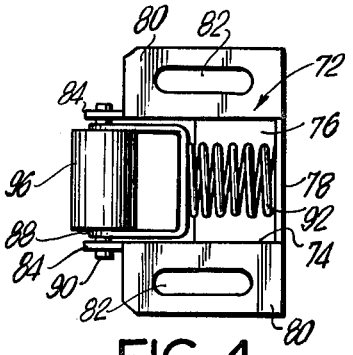
FIG. 4 is a top plan view of the roller assembly.

In order to provide an automatic closing feature for the slidable cover member, a particular arrangement of the lock and latching mechanism is utilized. With reference now to FIG. 4, the particular latching mechanism will be described.

The mechanism includes a U-shaped bracket 72 having sidewalls 74 interconnected by a base wall 76 and a rear wall 78. The sidewalls 74 extend upward and terminate in outwardly extending flanges 80 which include elongated slots 82 for adjustment. The sidewalls include forwardly directed extensions 84, each of which includes elongated slots 86 in the lower portions thereof.

A U-shaped yoke 88 has an axle 90 extending through the opposing legs of the yoke 88. The axle 90 also extends through the elongated slots 86 in the extensions 84 to hold the yoke captive between the extensions of the bracket sidewalls 74. A spring 92 is held between the rear wall 78 of the bracket and the connecting yoke bight 94, to forwardly bias the U-shaped yoke and push the axle 90 to the forward end of the elongated slots 86 as shown in FIG. 4. A roller 96 is rotatably positioned on the axle 90. The bracket 72 is securely positioned to the portion of the top wall 24 of the housing 12 by means of conventional rivets 98. The rivets extend through the elongated slots 82, which allow appropriate positioning of the roller assembly before securement thereof by the rivets, so that the roller 96 can be positioned to extend forward of the edge of the top wall portion 24.

Figure 5:
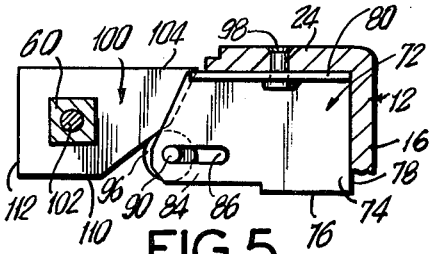
FIGS. 5–7 show three stages in the locking of the cover member onto the housing and utilizing the automatic locking feature.
Figure 6:
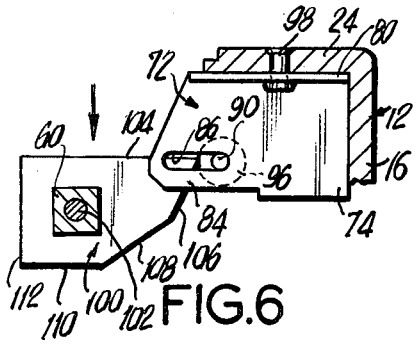
Figure 10:
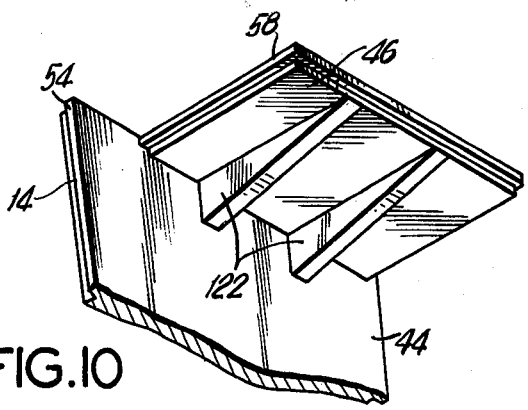
FIG. 10 shows a fragmentary isometric view of the rear top portion of the cover member.
Figure 7:
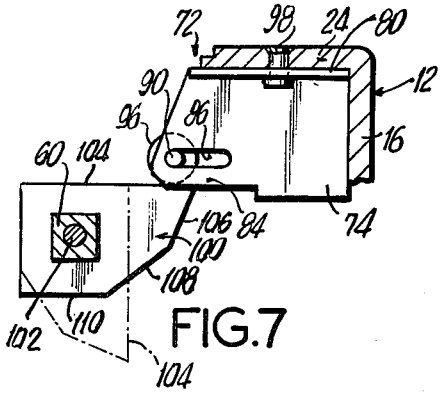

As can best be seen in FIG. 2, the lock 60 extending through the cover member 14 includes a barrel at the end of which is mounted a latch 100 securely held in place by means of a fastening member, such as a screw 102. As shown in FIGS. 5–7, the latch 100 is positioned on a rectangular portion of the rotatable cylinder of the lock 60 for turning or pivoting thereof between a locked and unlocked position, where in the locked position the latch 100 is securely retained in a laterally extending position shown in FIGS. 5–7. In the unlocked position, the latch 100 is turned downward, as shown in dotted lines in FIG. 7. The upper edge 104 of the latch 100 is substantially flat. The remaining edges include the cammed surfaces 106 and 108 which continue to the bottom edge 110. The side edge 112 of the latch 100 is made narrower than the top edge 104 thereof so that the side edge 112 will not engage the roller 96.

When the cover member is in its closed position, slid down over the housing, the relationship between the latch 100 and the roller assembly can best be seen in FIG. 7 in dotted lines. The latch is then slightly to one side of the roller assembly. In order to lock the cover member in place, the key is inserted into the lock 60 on the cover member, and the latch 100 is turned into its locked position, as shown in the solid lines, whereby the upper edge 104 is positioned beneath the roller 96 and is held latched by the roller 96. The cover member cannot be slid upwardly and removed from the housing because the latch is securely latched against the roller and holds the cover member in place.

When the cover member is to be removed, the lock is unlocked so that the latch 100 is turned into its disengaged or side position as shown in the dotted lines. In this position, the smaller edge 112 is now held on the top, and since it is narrower than the edge 104, it is no longer latched by the roller 96. The cover member can now be upwardly slid to gain access to the closure device being protected.

Because of the roller assembly, however, there is provided an automatic lock feature which permits the removal of the key from the lock before closing the cover member. After an individual unlocks the cover member and slides it upwardly, he can immediately relock the lock 60 while the cover member 14 is in its open position, and therefore can remove his key from the lock 60. The latch 100 will then be laterally extended. However, it will now be above the housing 12 and also above the roller assembly. When the individual wants to close the cover member onto the housing and lock it in place, he does not have to use the key, but the lock will automatically be locked in place.

As is seen in FIG. 5, when the cover member is above the housing, the latch 100 is above the roller assembly. As the latch is moved downward with the cover member, the cam surfaces 108 and 106 of the latch will displace the roller 96 and force it to the right as shown in FIG. 6. The axle 90 will ride in the elongated slots 86 and move aside to permit the locked latch to pass alongside the roller. Once the latch has passed the roller, the roller will be forced back into its original position by means of the biasing spring 92 and the latch will now be latched in place under the roller, as shown in FIG. 7.

As a result, because of the automatic locking feature, the cover member can be held in its open position with the lock already locked. When the user wishes to leave his premises, he locks his door lock in the usual manner and then need only slide down the cover member over the housing and it automatically locks into place on the housing. This provides a convenience and avoids the necessity of extra time, effort, and cumbersome manipulations. This also provides a safety feature, whereby the cover member lock can be manufactured so that the key can only be removed in the locked position, thus insuring that the cover member is always locked when in the closed position with the key removed from the lock. When returning to the premises, the user must use his keys to open the door lock. He must first, however, open the protective box. He can do this by simply turning the latch into its downward position and sliding the cover member upward. He can then automatically relock the lock of the cover member to place it in position for subsequent closure, and remove his key from the cover member lock. He can then open the door lock and gain access to the premises.

Figure 8:
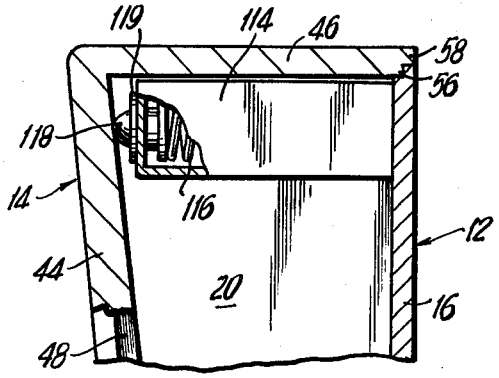
FIGS. 8 and 9 show respectively the cover member in its closed and open positions, and particularly point out the restraining mechanism for avoiding complete removal of the cover member from the housing.
Figure 9:
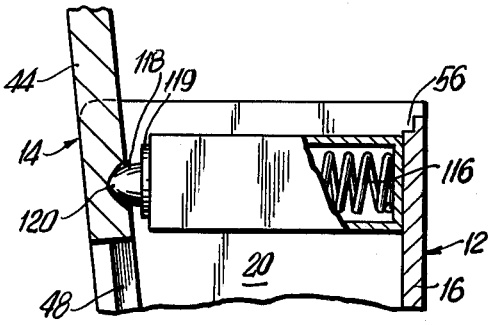

In order to prevent the cover member from getting lost by sliding the cover member completely from the housing, a holding mechanism is utilized, as will be explained with regard to FIGS. 8 and 9. A hollow member or post 114 is positioned in the housing 12 along the sidewall 20 adjacent the top of the housing, as best shown in FIGS. 1, 8 and 9. Within the hollow post is contained a biasing spring 116 which forces a pin 118 into a forward direction. The pin 118 includes a collar to prevent its complete removal from the post, where a stop washer-like member 119, disposed on the front of the post around the pin, retains the collar within the post. The pin 118 is spring loaded by spring 116 to force it against the inner surface of the cover member 14. With the cover member in its closed position, as shown in FIG. 8, the inner surface of the cover member will push against the spring loaded pin and hold it in its retracted position.

Adjacent the bottom edge of the cover member 14 is a detent 120 provided in the inner surface thereof and suitable for receiving the spring loaded pin. As the cover member is moved upwardly into its open position, the spring loaded pin will engage and mate with the detent 120 to hold the cover member up and restrain its complete removal from the housing. As a result, the cover member is moved upwardly and is held in place without necessarily removing the cover member from the housing. It is also noted, that the spring loaded pin, when it bears against the inside surface of the cover member, frictionally retards the sliding movement of the cover member to hold the cover member in any raised position.

In order to provide additional support for the cover member, gussets or reenforcement ribs 122 are placed between the top plate portion 46 and the panel portion 44 to securely hold the cover member together. As a result, the top plate portion 46 can be used as a handle for pushing the cover member down into place since it is well supported and will not easily break.

Figure 11:
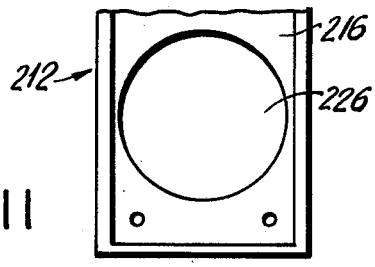
FIG. 11 shows a schematic drawing of a portion of the housing member in accordance with another embodiment of the present invention.

The housing can be used without the downward depending plate 34 shown in FIG. 1. In fact, the size of the opening in the rear wall of the housing can be made extremely large, as shown in FIG. 11. In this embodiment, an enlarged hole 226 is shown in the rear wall 216 of the housing 212. The large hole 226 can be used for any type of item to be protected such as a large nut, bolt, combination lock, pad lock, etc. The item to be protected would be accessible or extend through the hole 226 into the enclosure within the housing 212 and will be securely protected by means of the lockable cover member in the same manner as set forth above, where all the other features mentioned above would remain the same.

Figure 12:
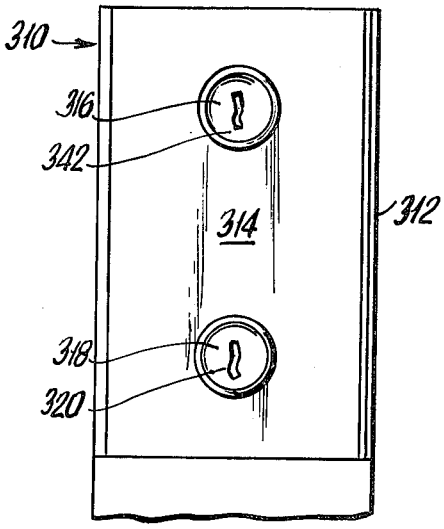
FIG. 12 shows a schematic front elevational view of a modified form of the protective box having two locks.

FIG. 12 shows a modified protective box 310 of the present invention provided with a housing 312 and a cover member 314. The protective box 310 includes two locking means 316, 318 coupled between the cover member 314 and the housing 312 for securely retaining the cover member in a closed position. The features of the locking means 316, 318 will be discussed hereinafter below, where all the other features of the protective box mentioned above will substantially remain the same.

Figure 13:
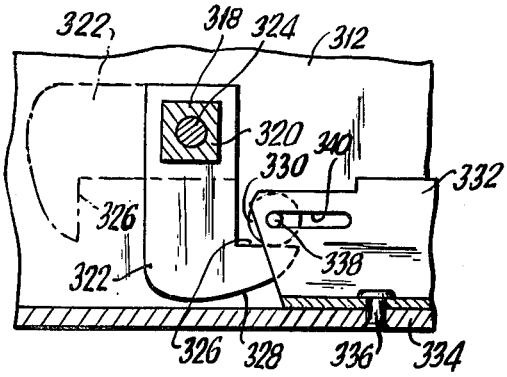
FIG. 13 shows a fragmented sectional view of a modified locking arrangement.

The lower locking means 318 includes a conventional key operated lock 320 having a latch 322 mounted on the inner end thereof, the latch being securely held in place by means of a screw 324. The latch 322 is positioned on a rectangular portion of the rotatable cylinder of the lock 320 for turning or pivoting thereof between a locked and unlocked position, where the locked position defines a downwardly extending position as shown in FIG. 13. In the unlocked position, the latch 322 is turned upwardly to a laterally extending position as shown in dotted lines in FIG. 13.

The latch 322 is provided with a substantially flat edge 326, and is also provided with a cammed surface 328 extending from the edge 326. The edge 326 and the cammed surface 328 are positioned for engagement with the spring biased roller 330 of the U-shaped bracket assembly 332 which is secured to the bottom wall 334 of the housing 312 by conventional rivets 336. The U-shaped bracket assembly 332 is similar to the above mentioned U-shaped bracket assembly 72 and functions in the same manner so that the roller 330 is rotatably positioned on the axle 338 for linear movement along the elongated slots 340.

Thus, when the cover member is being closed, with the lock 320 in its locked position, the latch 322 will move downward with the cover member, and the cammed surface 328 of the latch will displace the spring biased roller 330 and force it to the right, according to the showing in FIG. 13. Once the latching portion has passed the roller, the roller will be forced back into its original position by means of the biasing spring, and the edge 326 of the latch will be locked in place under the roller as shown in FIG. 13. In order to open the cover member, the lock 320 is unlocked using a proper key so that the latch 322 is rotated clockwise to the unlocked position shown in dotted lines in FIG. 13.

It is noted, that the locking means 318 can be used by itself or in combination with the locking means 316 shown in FIG. 12. It is also noted, that the tumblers in the locking means 316 and 318 can be positioned so that only one proper key is necessary in order to open both locking means 316, 318. Furthermore, the locking means 316 can be the same as set forth above with reference to lock 60, latch 100 and bracket 72, shown best in FIGS. 5–7, or can be a modified locking means as set forth below and shown in FIGS. 14 and 15. However, it should further be noted, that the locking means 316 shown in FIGS. 14 and 15 can replace the locking means shown in FIGS. 4–7 and be used by itself in the protective box of the present invention.

The locking means 316 includes a conventional key operated lock 342 having a sprocket wheel 344 mounted on the inner end thereof, the sprocket wheel being securely held in place by means of a screw 346. The sprocket wheel is positioned on a rectangular portion of the rotatable cylinder of the lock 342 for rotation thereof between a locked and unlocked position. The sprockets of the sprocket wheel 344 are engaged in notches or cutouts provided in the parallel, spaced apart latches 348 and 350. It is understood that only one of the latches 348, 350 is necessary according to the present invention, however, two latches are preferred.

The latches are held in place by guide means 352 and 354 which are secured to the inner surface of the cover member 314 so as to permit the latches 348 and 350 respectively to slide therethrough. Each of the latches 348, 350 is provided with a substantially flat upper edge 356 and 358 respectively, and is also provided with a cammed surface 360 and 362 respectively. The edge 356 and the cammed surface 360 of the latch 348 are positioned for engagement with the spring biased roller 364 on one side of the housing, and the edge 358 and the cammed surface 362 of the latch 350 are positioned for engagement with the spring biased roller 366 on the opposite side of the housing as best shown in FIG. 14.

The U-shaped bracket assemblies 368 and 370, which are provided with the above mentioned rollers 364, 366 respectively, are secured to the opposite sidewalls 372, 374 of the housing 312 by conventional rivets 376, 378, respectively. These U-shaped bracket assemblies 368, 370 are similar to the above mentioned U-shaped bracket assemblies 72, 332, and function in the same manner so that the rollers 364, 366 are rotatably positioned on their associated axles for linear movement along the elongated slots in the bracket assemblies.

Figure 14:
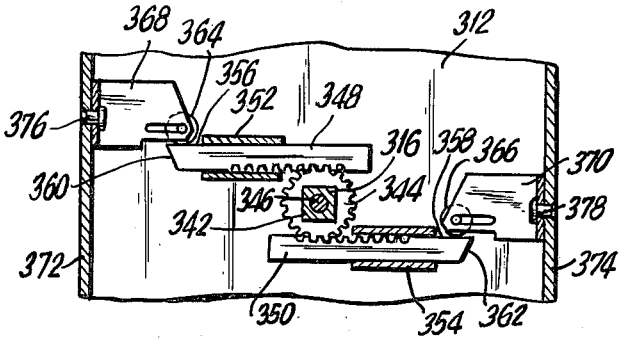
FIGS. 14 and 15 show fragmented sectional views of another modified locking arrangement.
Figure 15:
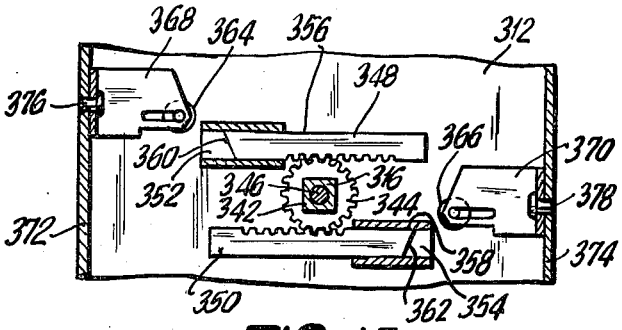

FIG. 14 shows the latches 360 and 362 in the locked position whereby the flat edges 356, 358 are positioned against the underside of the rollers 364, 366, respectively. FIG. 15 shows the latches 356, 358 in the unlocked position whereby the cammed surfaces 360, 362 are disposed in the guide means 352, 354, respectively and out of contact with the respective rollers 364, 366.

Thus, when the cover member is being closed, with the lock 342 in its locked position so that the latches 348, 350 extend outwardly in opposite directions from the guide means 352, 354, the latches 348, 350 will move downward with the cover member, and the cammed surfaces 360, 362 of the latches will displace their associated spring biased rollers 364, 366 and force roller 364 to the left and roller 366 to the right according to the showing in FIG. 14. Once the latching portions have passed the rollers, the rollers will be forced back into their original position by means of the biasing springs, and the upper edges 356, 358 of the latches will be locked in place under the rollers as shown in FIG. 14.

In order to open the cover member, the lock 342 is unlocked using a proper key so that the lock cylinder rotates the sprocket wheel 344 in a clockwise direction to linearly move the latches 348, 350 inwardly towards each other to the unlocked position shown in FIG. 15. The cover member 314 can now be moved upwardly relative to the housing 312, where both locking means 316, 318 are in their unlocked positions so that none of the latches engage any of the rollers in the upward movement of the latches.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A protective box for providing a secure covering for a closure device disposed on a support surface, such as a lock, bolt, and the like, said protective box comprising:

a housing having a rear wall and perimeter walls forwardly extending from said rear wall;

an opening in said rear wall for providing access to the closure device to be protected;

means for fastening said housing onto the support surface;

cover means for closing said housing, said cover means including a cover member covering a front portion of said housing defined by said perimeter walls, said cover member including slide means for permitting said cover member to slide on said perimeter walls between a closed position providing an enclosed area within said housing to protect the closure device, and an open position permitting access to the closure device;

lock means coupled between said cover member and said housing for securely retaining said cover member in said closed position;

said lock means including a lock disposed on said cover means, a latch coupled to said lock and operated thereby between a locked position and an unlocked position, and latching means disposed on said housing for engaging said latch in said locked position to prevent sliding of said cover member to said open position; and said latching means including a roller assembly comprising a bracket fastened to said housing, a laterally displaceable roller supported in said bracket, and biasing means for biasing said roller in a lateral direction toward said latch, said latch having upper and lower edges, said lower edge including a cam surface for displacing said roller and said upper edge including a substantially flat edge for engaging against said roller.

2. A protective box as in claim 1, where said lock includes means for rotating said latch between said locked and unlocked positions.

3. A protective box as in claim 1, wherein said lock includes means for moving said latch in a linear direction between said locked and unlocked positions.

4. A protective box as in claim 1, wherein said perimeter walls include sidewalls, a bottom wall, and a first portion of a top wall, said cover member including a rearwardly directed wall section defining a remaining portion of the top wall, so that in said closed position, said first and remaining portions of said top wall matingly provide a complete top surface for the enclosed area.

5. A protective box as in claim 4, and further comprising fastening means coupling said bracket to said first portion of said top wall with said roller being positioned downwardly of said top wall first portion and extending laterally beyond an edge of said top wall first portion, so that as said cover member is slid into said closed position, said cam surface of said latch can engage and displace said roller.

6. A protective box as in claim 4, and further comprising fastening means coupling said bracket to said bottom wall with said roller being positioned upwardly of said bottom wall to provide a space therebetween for said latch in said closed position of said cover member.

7. A protective box as in claim 4, and further comprising fastening means coupling said bracket to one of said sidewalls with said roller being positioned outwardly from said one sidewall.

8. A protective box for providing a secure covering for a closure device disposed on a support surface, such as a lock, bolt, and the like, said protective box comprising:

a housing having a rear wall and perimeter walls forwardly extending from said rear wall, said perimeter walls including at least two sidewalls and a bottom wall;

an opening in said rear wall for providing access to the closure device to be protected;

means for fastening said housing onto the support surface;

cover means for closing said housing, said cover means including a cover member covering a front portion of said housing defined by said perimeter walls, said cover member including slide means for permitting said cover member to slide on said sidewalls between a closed position providing an enclosed area within said housing to protect the closure device, and an open position permitting access to the closure device;

lock means coupled between said cover member and said housing for securely retaining said cover member in said closed position;

said lock means including a lock disposed in said cover member for movement therewith, a latch coupled to said lock and operated thereby between a locked position and an unlocked position, and latching means disposed on said housing for engaging said latch in said locked position to prevent sliding of said cover member to said open position;

said slide means including tongue and groove joints provided between side edges of said cover member and edge portions of said sidewalls of said housing, said cover member having an outside surface disposed in same plane as said edge portions of said sidewalls to prevent penetration of said enclosed area within said housing;

said cover member including a rearwardly directed top wall, a seat provided along an upper edge of said rear wall of said housing and a lip provided at an outer edge of said top wall of said cover member, said lip and seat matingly engaging in said closed position to provide an overlap joint with an upper surface of said top wall being disposed in same plane as said upper edge of said rear wall to prevent penetration of said enclosed area within said housing; and said housing including holding means for holding said cover member in any selected raised position, said holding means including a forwardly directed spring loaded pin biased toward said cover member for bearing against an inside surface of said cover member to frictionally retard its sliding movement, said holding means permitting said cover member to be lowered to said closed position when a downward force greater than the frictional force of said spring loaded pin is applied on said cover member.

9. A protective box as in claim 8, and further comprising a detent provided in an inside surface of said cover member for matingly receiving said pin therein, said pin and detent being respectively positioned on said housing and said cover member for restraining sliding removal of said cover member from said housing.

10. A protective box as in claim 8, and further comprising a plate downwardly depending from said rear wall of said housing and including an opening for receiving a corresponding cooperating part of the closure device.

11. A protective box as in claim 1, wherein said lock means includes two locks disposed on said cover means, and two of said latching means disposed on said housing for engaging said locks when in a locked position to prevent sliding of said cover member to said open position.

* * * * *